United States Patent [19]

Geddes

[11] Patent Number: 4,600,145

[45] Date of Patent: Jul. 15, 1986

[54] RAILROAD SLEEPER LOCK-IN SHOULDER

[75] Inventor: Norman R. Geddes, Seaview Downs, Australia

[73] Assignee: Omark Industries, Inc., Portland, Oreg.

[21] Appl. No.: 559,307

[22] Filed: Dec. 7, 1983

[30] Foreign Application Priority Data

Dec. 7, 1982 [AU] Australia ..... PF7156

[51] Int. Cl.[4] ..... E01B 9/34

[52] U.S. Cl. ..... 238/351; 238/310

[58] Field of Search ..... 238/310, 338, 349, 351, 238/341

[56] References Cited

U.S. PATENT DOCUMENTS

| | | | |
|---|---|---|---|
| 846,724 | 3/1907 | Bowman | 238/349 X |
| 1,798,092 | 3/1931 | Lossl | 238/338 X |
| 2,085,970 | 7/1937 | Greene | 238/349 |
| 2,333,518 | 11/1943 | Burkhardt | 238/349 |
| 3,356,299 | 12/1967 | Boyer | 238/310 X |
| 4,023,732 | 5/1977 | Mathis | 238/338 |
| 4,312,478 | 1/1982 | Matsuo et al. | 238/349 |
| 4,325,510 | 4/1982 | Sherrick | 238/341 |

FOREIGN PATENT DOCUMENTS

| | | | |
|---|---|---|---|
| 657980 | 3/1938 | Fed. Rep. of Germany | 238/349 |
| 2921826 | 12/1979 | Fed. Rep. of Germany | 238/349 |
| 620975 | 5/1961 | Italy | 238/349 |
| 360085 | 3/1962 | Switzerland | 238/349 |
| 1434560 | 5/1976 | United Kingdom . | |
| 1481645 | 8/1977 | United Kingdom | 238/310 |

*Primary Examiner*—Robert B. Reeves
*Assistant Examiner*—David F. Hubbuch
*Attorney, Agent, or Firm*—Duffield & Lehrer

[57] ABSTRACT

A lock-in shoulder is provided with a head at its upper end which, upon assembly, engages the upper surface of a "U" shaped knock-on clip, abutment wings which abut the upper surface of a sleeper, a rail engaging surface which engages an edge of the rail foot, a back surface which engages a surface of an aperture through the sleeper, and an upwardly facing surface which engages the sleeper underface.

17 Claims, 6 Drawing Figures

RAILROAD SLEEPER LOCK-IN SHOULDER

BACKGROUND OF INVENTION

This invention relates to a railroad sleeper lock-in shoulder and further to such a shoulder when associated with a sleeper rail and fastener to form an assembly to fasten a pair of rails to a sleeper. In our Australian patent application No. 83610/82 lodged on May 12, 1982 and published July 25, 1983 there was described and claimed a resilient fastener clip of general "U" shape arranged to have its upper leg bearing upwardly against the head of a "T" head restraining member, its heel bearing downwardly and against the sleeper and its lower toe bearing downwardly against the rail foot. Clips made in accordance with that invention have proved to be technically successful, and this invention is associated with certain improvements wherein such a clip can be used in conjunction with the shoulder which can be locked into an aperture in the sleeper by the rail foot itself.

There are many advantages in the use of a "knock-on" clip, as distinct from clips secured, for example, by screw threaded fasteners. The "knock-on" clip has such a shape that rail vibration will return it to its required position (if displaced). A "knock-on" clip of the type described herein has an excellent spring rate, which will tolerate settlement of a rail pad formed from polymeric material, with only slight loss of rail foot pressure. It will resist rail creep better than any known type of other fastener clip. It is easily assembled to a rail, and although it resists dislodgement, for example by vandals, it can be easily removed with an appropriate tool. It has a low profile and will allow free movement of a rail track machine, offering little or no obstruction. Above all, in use its failure rate is negligible.

However its use normally requires the addition of a "T" headed stud welded to the upper surface of a sleeper. In many instances it is much preferred to drill a hole in a sleeper, and the main object of this invention is to provide a successful lock-in shoulder which can be used in conjunction with such a configuration.

Lock-in shoulders have been proposed heretofore, and for example the reader's attention is drawn to British specification No. 1,434,560 directed to a three-part fastener (shoulder, clip and retaining pin). U.S. Pat. No. 3,442,452 discloses a "U" shaped clip which engages a cast-in shoulder or retention member embodied in concrete. U.S. specification No. 3,356,299 Boyer discloses a lock-in clip with a screw threaded fastener bearing downwardly on a rail foot in such a way that there is a large unlocking moment tending to rotate the clip out of its retaining slot. However, the most pertinent prior art known to the Applicant is to be found in U.S. specification No. 2,085,970 Greene which shows a lock-in sleeper having a foot which bears upwardly against the under surface of a sleeper, and is retained in that position by a spring clip. However, there is an inherent instability in the arrangement shown, for example, in FIG. 3 of the Greene drawing. If moments are taken about the uppermost point where the lock-in block contacts the rail foot, it will be seen that clockwise rotation is inhibited solely by the depressed portion of the clip (near its heel) contacting a surface (4) of the sleeper. However, the direction of possible rotation is such that the contact is oblique, not "square-on". Lateral forces imparted by the rail foot will not correct this anomaly.

BRIEF SUMMARY OF THE INVENTION

Briefly, in this invention, a lock-in shoulder is provided with a head at its upper end which, upon assembly, engages the upper surface of a "U" shaped knock-on clip, abutment wings which abut the upper surface of a sleeper, a rail engaging surface which engages an edge of the rail foot, a back surface which engages a surface of an aperture through the sleeper, and an upwardly facing surface which engages the sleeper underface.

With this arrangement, whether the sleeper underface is engaged by the upwardly facing surface vertically beneath the rail foot or otherwise, the lock-in shoulder is inherently stable and will resist displacement or dislodgement under even the most extreme conditions encountered by a railroad track. In the worst condition of the invention, the moment arm acting on the shoulder is so small as to be negligible and overturn will be resisted (e.g. FIG. 1 herein), while the best condition (FIGS. 5 or 6), the shoulder is absolutely stable and completely resists dislodgement (other than actual breaking of the shoulder).

More specifically, the invention consists of a railroad sleeper lock-in shoulder having a head at its upper end, sleeper abutment means intermediate its ends, a neck joining the head to the sleeper abutment means, a rail engaging surface which, upon assembly, engages a rail foot edge, a retaining block at its lower end and a stem located vertically beneath the head and depending from the sleeper abutment means to the retaining block, a back surface of the stem which, upon assembly, engages a surface of an aperture through the sleeper, said sleeper abutment means and retaining block having respectively downwardly and upwardly facing surfaces which are engageable respectively with the upper and under surface of an apertured sleeper when the head is inserted through said aperture therein.

However the invention is not limited necessarily to the shoulder itself and in another embodiment a railroad sleeper, rail and fastener assembly for fastening a pair of rails to a sleeper comprises two pairs of apertures in the sleeper, the apertures of each pair being located on respective opposite sides of the rail foot, the fastener assembly comprising two pairs of lock-in shoulders, each shoulder being as defined herein and having a said stem located in a said aperture, and said downwardly and upwardly facing surfaces engaging respectively the upper and under surfaces of the sleeper, and respective resilient fastener clips bearing upwardly against said shoulder heads and downwardly against said upper sleeper surfaces.

BRIEF SUMMARY OF THE DRAWINGS

Embodiments of the invention are described hereunder in some detail with reference to, and are illustrated in, the accompanying drawings in which.

DETAILED DESCRIPTION OF INVENTION

In the first embodiment of FIGS. 1, 2, 3 and 4, an assembly comprises a railroad sleeper 10, a pair of rails 11 and a fastener assembly 12. The drawings illustrate only one rail for simplicity, but the rails are arranged in the usual fashion as a pair of rails.

Figure 1:
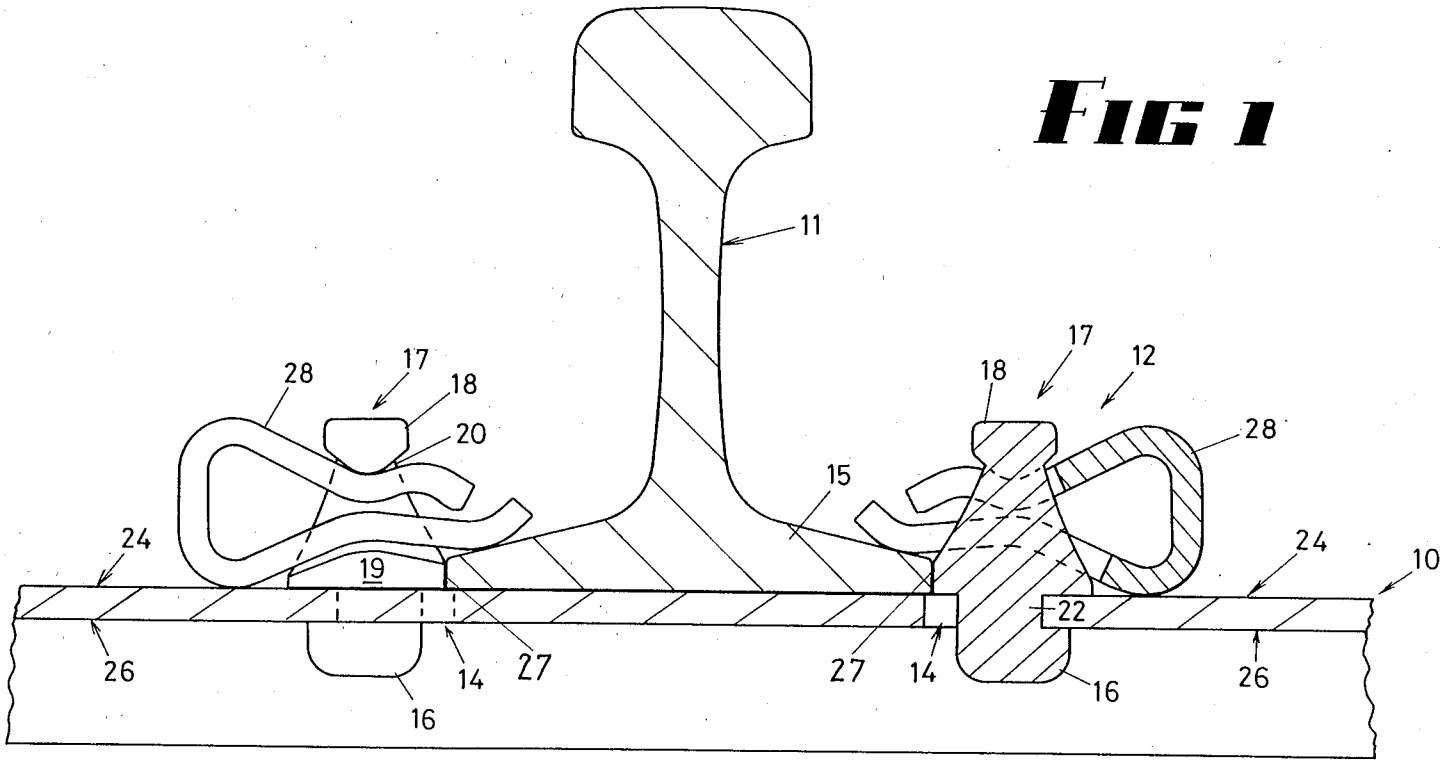
FIG. 1 shows one rail of the pair of rails secured to a sleeper.
Figure 3:
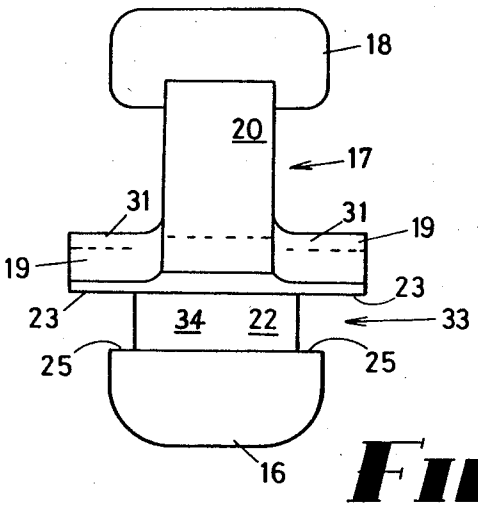
FIG. 3 is an end elevation of FIG. 2.
Figure 2:
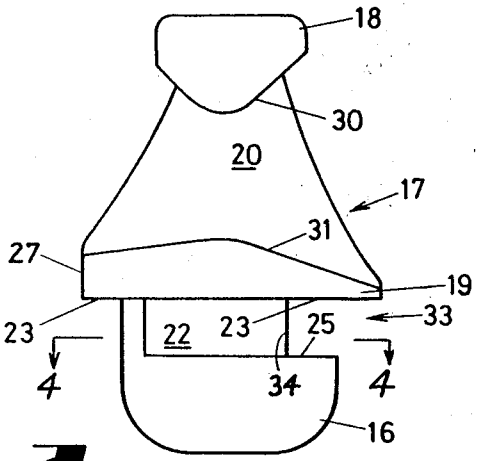
FIG. 2 is a side elevation of a lock-in shoulder (viewed in the direction of the rail)
Figure 4:
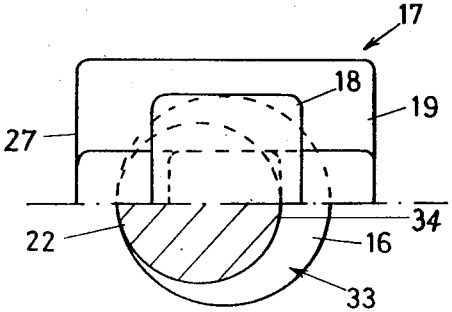
FIG. 4 is a plan taken in the direction of arrow 4 of FIG. 2, but shown in half section in the section line 4—4 of FIG. 2.

The sleeper 10 is provided with two pairs of sleeper apertures 14 each flanking the foot 15 of a respective rail 11, each aperture being of sufficient size to allow passage therethrough of the retaining block 16 of the lock-in shoulder 17, which is illustrated in more detail in FIGS. 2, 3 and 4. Each lock-in shoulder 17 comprises a head 18 at its upper end, abutment wings 19 intermediate its ends, and a neck 20 which joins the abutment wings 19 to the head 18. A stem 22 joins the abutment wings 19 to the retaining block 16 which is spaced therefrom. The abutment wings 19 have respective downwardly facing surfaces 23 which bear against the upper surfaces 24 of the sleeper 10, while the block 16 has an upwardly facing surface 25 which bears against the under surface 26 of the sleeper 10.

The size of each sleeper aperture 14 is such that the block 16 will pass through it and the shoulder can then move laterally away from the rail and is retained in that position by the rail foot 15 engaging a rail engaging surface 27 of wings 19. The rail foot is retained to the sleeper 10 by means of U-shaped resilient clips 28 which are substantially in accordance with the description and claims of the said Australian patent application No. 83610/82 and having a lower toe bearing downwardly on the rail foot 15, an upper toe which bears upwardly against head 18, and a heel which bears downwardly against sleeper upper surface 24.

The under surface of the head 18 where its portions project outwardly of the neck comprise downwardly facing convex abutment surfaces 30, and upper surfaces 31 of the wings 19 include lead-in ramp surfaces which facilitate driving the clips 28 into position.

As seen best in FIG. 4 both the stem 22 and the retaining block 16 are of generally circular section but are eccentric with respect to one another so as to define a crescent shaped recess 33, this recess being bounded also by the wing and block surfaces 23 and 25, respectively. The vertical wall 34 of recess 33 is a back surface, urged into contact with the surface of aperture 14 by the rail foot engaging surface 27 of shoulder 17.

In the first embodiment, the upward force applied to the shoulder 17 by clip 28 is resisted by the surface 25 of block 16 bearing upwardly against under surface 26 of sleeper 10. Roll-out of the shoulder 17 from aperture 14 is inhibited by engagement of the surfaces 23 and 25, and engagement against the foot of the rail, all of which prevent rotation. It will also be seen that the moment arm tending to produce rotation when rail forces are applied is so small as to be negligible.

Figure 5:
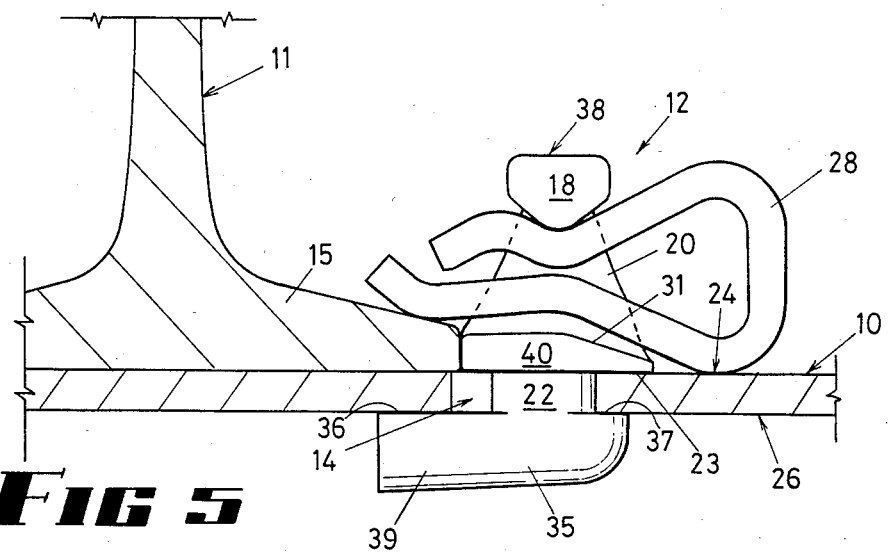
FIG. 5 is a section showing a second embodiment.

In the arrangement of FIG. 5, however, the stem 22 is intermediate the ends of an elongate block 35, so that the block has two upwardly facing surfaces 36 and 37, both of which bear upwardly against the under surface 26 of the sleeper 10. The upward force applied to the head 18 of the shoulder 38 is resisted by both the surfaces 36 and 37, so that no turning moment at all is applied. Even if there were, however, the inwardly facing leg 39 of block 35 is elongate and thereby provides great resistance to any tendency of the shoulder to roll out of its aperture. Wings 40 function as in the first embodiment.

Figure 6:
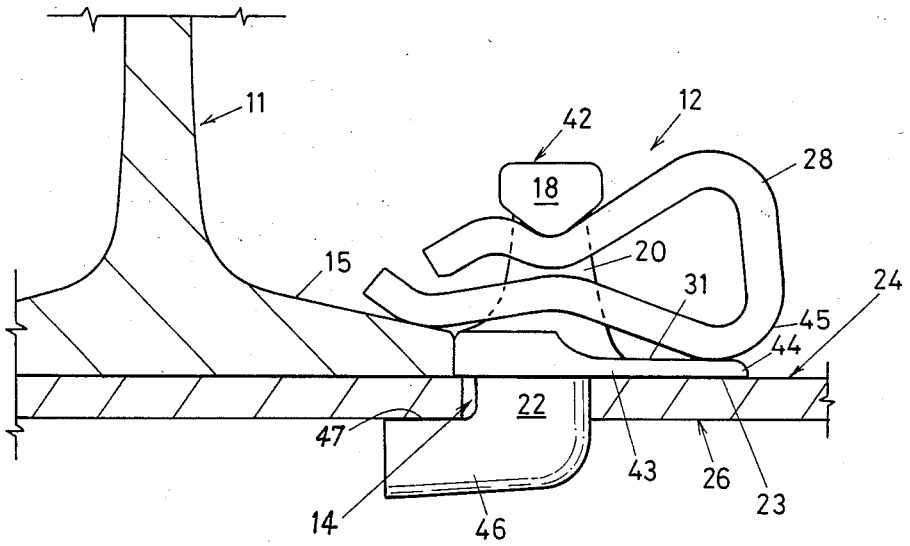
FIG. 6 is a section showing a further embodiment.

In the arrangement of FIG. 6, the shoulder 42 has wings 43, as in the other embodiments, but the wings 43 extend outwardly in a tail 44, against which the heel 45 of the clip 28 bears. The lower toe of clip 28 bears downwardly on the foot 15 of rail 11. The stem 22 joins retaining block 46 in an "L" configuration, and any tendency of the shoulder to roll out in an anticlockwise direction (as drawn) is inhibited by the clip 28 itself. Upwardly facing surface 47 of block 46 bears against the sleeper under surface 26.

In summary, the combination of the rail foot urging the shoulder into contact with the aperture surface, and the shoulder retaining force, imparted by the clip, acting upwardly on the head 18 which is above stem 22, avoids any moment arm of sufficient magnitude to be effective in overturning the shoulder.

In both the second and third embodiments, the downward pressure of the clip on the rail foot is vertically aligned with the retaining block so that there is an absence of eccentric forces, and optimum conditions exist for rail retention.

What is claimed is:

1. A railroad sleeper lock-in shoulder usable on a sleeper having an aperture therethrough, said shoulder having a head at its upper end, sleeper abutment means intermediate its ends, a neck joining the head to the sleeper abutment means, a rail engaging surface which, upon assembly, engages a rail foot edge, a retaining block at its lower end and a stem located beneath the head and depending from the sleeper abutment means to the retaining block, a back surface of the stem, said sleeper abutment means and retaining block having respectively downwardly and upwardly facing surfaces which, with said stem back surface, define a slot, said downwardly and upwardly facing surfaces being engageable respectively with the upper and under surface of said sleeper when the retaining block is inserted through said aperture therein and moved laterally to engage said back surface with a surface of said sleeper aperture.

2. A railroad sleeper lock-in shoulder according to claim 1 further comprising wings which extend laterally outwardly from said stem, said downwardly facing surfaces being surfaces of said wings.

3. A railroad sleeper lock-in shoulder according to claim 1 or claim 2 wherein said stem and said retaining block are both of circular cross-sectional shape but eccentric with respect to each other and define between them said slot, said slot also being crescent shaped in cross-section.

4. A railroad sleeper lock-in shoulder according to claim 2 wherein upper surfaces of said wings include ramp surfaces.

5. A railroad sleeper lock-in shoulder according to claim 1 wherein the said head and neck define a "T" shape in end elevation and wherein said head comprises downwardly facing convex abutment surfaces in side elevation.

6. An assembly for fastening a rail to a sleeper which has a pair of spaced apertures therein, one each side of the rail foot, comprising a pair of lock-in shoulders each according to claim 1 or claim 5, each said lock-in shoulder having a rail engaging surface which engages an edge of the rail foot and thereby retains said back surface in engagement with said surface of its respective said aperture through the sleeper, and a pair of U-shaped clips each having a lower toe bearing downwardly on said rail foot, an upper toe bearing upwardly against said head, and a heel bearing downwardly on the upper surface of said sleeper.

7. A railroad sleeper lock-in shoulder according to claim 1 wherein said retaining block is elongate and its upwardly facing surfaces bridge said sleeper aperture and engage the sleeper under surface on two sides of said stem.

8. An assembly for fastening a rail to a sleeper which has a pair of spaced apertures therein, one each side of the rail foot, comprising a pair of lock-in shoulders each according to claim 7, each said lock-in shoulder having a rail engaging surface which engages an edge of the rail foot and thereby retains said back surface in engagement with said surface of its respective said aperture through the sleeper, each said retaining block bridging its said aperture and its upwardly facing surfaces engaging the sleeper under surface on two sides of said stem, and a pair of U-shaped clips each having a lower toe bearing downwardly on said rail foot, an upper toe bearing upwardly against said head, and a heel bearing downwardly on the upper surface of said sleeper.

9. A railroad sleeper lock-in shoulder according to claim 1 wherein the rail engaging surface has at least a portion thereof of configuration complementary to the edge of the rail to prevent rotation of the lock-in shoulder once the rail is in place.

10. The lock-in shoulder of claim 9 wherein the rail engaging surface of the lock-in shoulder, once in engagement with the rail, retains the back surface of the stem in engagement with the surface of the sleeper aperture.

11. The lock-in shoulder of claim 1 wherein the rail engaging surface of the lock-in shoulder, once in engagement with the rail, retains the back surface of the stem in engagement with the surface of the sleeper aperture.

12. The railroad sleeper lock-in shoulder of claim 1 wherein the downwardly facing surface of the sleeper abutment means and the upwardly facing surface of the retaining block are in vertical alignment with one another.

13. A railroad sleeper lock-in shoulder for securing a railroad rail having a rail foot to a railroad sleeper having an upper and lower surface and an aperture therein by means of a resilient rail clip comprising:

a railroad lock-in shoulder having a head for securing the rail clip;

a neck;

sleeper abutment means of configuration incapable of passing through the aperture and joined to the head by the neck and having a downwardly facing surface adapted to contact the upper surface of the sleeper;

a retaining block of configuration capable of passing through the aperture and having an upwardly facing surface adapted to contact the under surface of the sleeper;

a stem having a back surface joining the sleeper abutment means and the retaining block together;

a rail engaging surface disposed opposite the back surface of the stem adapted to engage the rail foot; and the sleeper abutment means and associated downwardly facing surface and retaining block and associated upwardly facing surface being so orientated, one to another, to interlock the shoulder with the sleeper when the retaining block is positioned within the aperture and the back surface is in contact with the aperture of the sleeper and the rail engaging surface is in contact with the rail foot.

14. The lock-in shoulder of claim 13 wherein the rail engaging surface of the lock-in shoulder, once in engagement with the rail, retains the back surface of the stem in engagement with the surface of the sleeper aperture.

15. A rail sleeper lock-in shoulder according to claim 13 wherein the rail engaging surface has at least a portion thereof of configuration complementary to the edge of the rail to prevent rotation of the lock-in shoulder once the rail is in place.

16. The lock-in shoulder of claim 15 wherein the rail engaging surface of the lock-in shoulder, once in engagement with the rail, retains the back surface of the stem in engagement with the surface of the sleeper aperture.

17. The railroad sleeper lock-in shoulder of claim 16 wherein the downwardly facing surface of the sleeper abutment means and the upwardly facing surface of the retaining block are in vertical alignment with one another.

* * * * *